United States Patent [19]

Deal et al.

[11] 4,041,347

[45] Aug. 9, 1977

[54] CATHODE-RAY TUBE HAVING CONDUCTIVE INTERNAL COATING EXHIBITING REDUCED GAS ABSORPTION

[75] Inventors: Samuel Broughton Deal, Lancaster; Donald Walter Bartch, Columbia, both of Pa.

[73] Assignee: RCA Corporation, New York, N.Y.

[21] Appl. No.: 615,681

[22] Filed: Sept. 22, 1975

[51] Int. Cl.[2] ..... H01J 29/46

[52] U.S. Cl. ..... 313/450; 313/479; 427/64

[58] Field of Search ..... 313/450, 479, 480; 427/64, 68, 106, 162, 165, 204

[56] References Cited

U.S. PATENT DOCUMENTS

| | | | |
|---|---|---|---|
| 3,108,906 | 10/1963 | Scharrer et al. | 313/450 X |
| 3,552,992 | 1/1971 | Self et al. | 220/2.1 |
| 3,898,509 | 8/1975 | Brown, Jr. et al. | 313/478 |

*Primary Examiner*—Rudolph V. Rolinec
*Assistant Examiner*—Lawrence J. Dahl
*Attorney, Agent, or Firm*—G. H. Bruestle; L. Greenspan

[57] ABSTRACT

A cathode-ray tube having a conductive internal coating comprised of carbon, optionally iron oxide, lithium silicate and at least one of sodium and potassium silicates on the interior walls of the tube.

10 Claims, 1 Drawing Figure

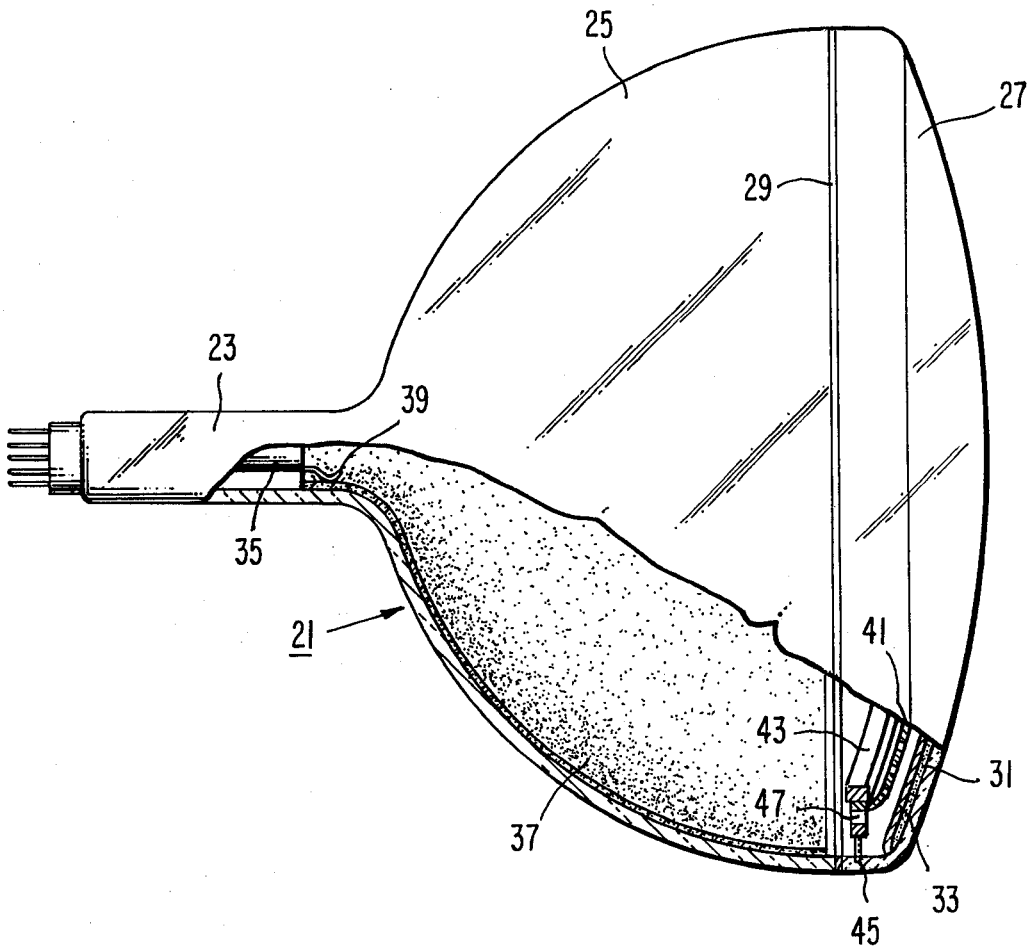
25
27
29
23
39
35
21
41
43
31
47
37
33
45

CATHODE-RAY TUBE HAVING CONDUCTIVE INTERNAL COATING EXHIBITING REDUCED GAS ABSORPTION

BACKGROUND OF THE INVENTION

This invention relates to an improved cathode-ray tube having an internal coating comprised of carbon and a combination of silicates on the interior walls of the tube.

Cathode-ray tubes usually have a conductive internal coating on the interior walls of the tube. This coating is used to carry a high potential of the order of 15 to 30 kilovolts, which is applied at the anode button. The most common internal coating consists essentially of particulate graphite and an alkali silicate binder. The coating is applied to the walls of the tub by spraying and/or brushing as an aqueous coating composition, then dried, and then baked in air at about 400° C for 1 hour. After baking, this prior-art coating absorbs water vapor, carbon dioxide and possibly other gases from the ambient atmosphere. Subsequently, just prior to the tipping off step, the tube is baked and exhausted of gases down to a pressure of about $10^{-6}$ torr, one purpose of which is to remove adsorbed gas from the internal coating. While this treatment is largely successful, very small amounts of adsorbed gases continue to be released during the operation of the tube. When these gases react with the cathode of the tube, the cathode becomes less efficient and finally inoperative to emit electrons. It is therefore desirable to reduce the amounts of gases released from the internal coating, at least to extend the life of the cathode.

SUMMARY OF THE INVENTION

The novel cathode-ray tube comprises an evacuated glass envelope and a conductive internal coating adhered to at least a portion of the interior walls of the envelope. The internal coating consists essentially of carbon particles, optionally iron oxide particles, and a binder therefor comprising a mixture of lithium silicate and at least one of sodium and potassium silicates. The preferred coating contains graphite particles, iron oxide, and all three silicates. The coating is of such thickness and composition as to provide a point-to-point electrical resistance of about 200 to 2,000 ohms per inch.

The internal coating in the novel tube, as compared with prior internal coatings, is more adherent to glass, and has a lower alkalinity. Because of this lower alkalinity, the coating absorbs less water vapor, carbon dioxide and possibly other gases from the ambient atmosphere during tube fabrication. This lower gas adsorption results in longer tube life since there is less gas to be released from the coating during the operation of the tube. The coating has an adequate conductivity and is otherwise compatible in performance with prior coatings. In addition, the internal coating may be applied from an aqueous coating composition by presently used techniques.

BRIEF DESCRIPTION OF THE DRAWING

The sole FIGURE is a partially broken-away longitudinal view of a novel cathode-ray tube of the invention.

DESCRIPTION OF THE PREFERRED EMBODIMENT

The cathode-ray tube illustrated in the sole figure is an apertured-mask-type kinescope. The tube includes an evacuated envelope designated generally by the numeral 21, which includes a neck 23 integral with a funnel 25, and a faceplate or panel 27 joined to the funnel 25 by a seal 29, preferably of a devitrified glass. There is a luminescent layer 31 comprised of a phosphor material on the interior surface of the faceplate 27, and a light-reflecting metal coating 33, as of aluminum metal, on the luminescent layer 31. The luminescent layer 31, when suitably scanned by an electron beam or beams from a gun in a mount assembly 35 located in the neck 23, is capable of producing a luminescent image which may be viewed through the faceplate 27.

There is an electrically-conductive internal coating 37, consisting essentially of a muli-silicate binder, optionally iron oxide particles, and carbon particles, on a portion of the interior surface of the funnel 25 between the mount assembly 35 and the seal 29. Three metal fingers 39 space the mount assembly 35 from the neck wall and connect the forward portion of the mount assembly 35 with the internal coating 37.

Closely spaced from the metal coating 33 toward the mount assembly 35 is a metal mask 41 having a multiplicity of apertures therein. The mask 41 is welded to a metal frame 43 which is supported by springs 47, which are attached to the frame 43, on studs 45 integral with the panel 27. Inasmuch as the invention is concerned primarily with the conductive internal coating 37, a detailed description of the components and parts normally associated with the neck and faceplate 23 and 27 is omitted or shown schematically.

The tube of this example may be fabricated by methods known in the art. The mask 41, frame 43 and springs 47 are assembled. The luminescent layer 31 and the metal coating 33 are deposited on the inner surface of the faceplate 27. The conductive internal coating 37 is applied to the interior surface of the funnel 25 and an adjacent portion of the neck 23 as indicated in the sole FIGURE by any convenient method. For example, the internal coating 37 may be applied from an aqueous suspension in two steps. First, a portion is brushed on in the neck 23 and the adjacent portion of the funnel 25, and then a portion is sprayed on in the funnel 25, so that the sprayed-on portion overlaps the brushed-on portion. A typical coating formulation is as follows:

- 105 grams graphite (90% below 10 microns)
- 195 grams ferric oxide $Fe_2O_3$ (average particle size about 1.1 microns)
- 500 grams aqueous solution lithium silicate containing 20 weight percent lithium silicate (weight ratio $SiO_2/Li_2O$ is about 10.0)
- 300 grams aqueous solution containing 54 weight percent sodium silicate (weight ratio $SiO_2/Na_2O$ is about 2.0)
- 400 grams aqueous solution containing 30 weight percent potassium silicate (weight ratio $SiO_2/K_2O$ is about 2.2)
- 12 grams dispersant
- 300 grams deionized water This formulation has a viscosity of about 20.5 seconds after ball milling for about 10 hours. After application, the coating is dried in air.

Next, a bead of devitrifying glass frit is deposited on the seal land of the funnel 25. The frame 43 with the mask 41 and springs 47 attached thereto is mounted on the studs 45. The seal land of the panel 27 is placed against the bead of frit on the seal land of the funnel 25, and the assembly is heated at about 400° C until the frit melts and devitrifies and forms a vacuum-tight seal 29 between the panel 27 and the funnel 25. During the heating to form the seal 29, the heat also bakes the funnel coating 37, driving out moisture and rendering the funnel coating 37 electrically conductive and chemically stable to the atmosphere. Lower temperatures down to about 50° C may be used to render the coating chemically stable.

The metal fingers 39, the electron gun and the convergence assembly are assembled on a glass stem producing the mount assembly 35. The metal fingers 39 are depressed and inserted into the neck 23 and slid into the tube until the mount assembly 35 is at the desired position. The fingers 39 slide on a portion of the coating 37 during this step and may abrade some of the coating material therefrom, but the amount is smaller than what is abraded from most prior carbon-containing funnel coatings. Next, the glass stem is sealed to the neck 23. Finally, the entire tube is baked at about 440° C, the hot tube exhausted and then sealed. During this last baking step, moisture, water vapor, carbon dioxide and possibly other gases that are present in the funnel coating 37 are largely removed. The amount of gas which is picked up by the coating during tube processing is lower than for prior graphite-containing funnel coatings. This last baking may be conducted at temperatures as low as 50° c with substantially the same beneficial effects with respect to the internal coating.

GENERAL CONSIDERATIONS

The internal coating may be used in any cathoderay tube including picture tubes, display tubes, oscilloscopes, camera tubes and storage tubes. The coating is particularly suitable where an adherent conductive coating is desired on the interior glass surfaces of the tube. The conductive internal coating is prepared by applying to the interior surface of the glass funnel 25 a coating of an aqueous suspension of a desired composition, drying the coating and then baking the coating at about 50° to 450° C.

The suspension comprises 100 weight parts powdered carbon, 0 to 600 weight parts iron oxide particles, and about 50 to 400 weight parts of a mixture of silicate solids in an aqueous medium. Funnel coatings for use in kinescopes according to the invention preferably consist essentially of about 100 weight parts graphite, about 150 to 250 weight parts dehydrated ferric oxide and about 125 to 175 weight parts of a mixture of lithium, potassium and sodium silicate solids. A dispersant and water are added in amounts to adjust the coating qualities of the coating formulation as desired. Some suitable dispersants are Marasperse N-22 and CB (marketed by American Can Co.) and Triton X-100 (marketed by Rohm & Haas Co.). Combinations of Marasperse N-22 and CB are preferred.

The iron oxide is in anhydrous form and may be any oxide of iron, such as ferric oxide $Fe_2O_3$, ferrous oxide FeO, or ferroso-ferric oxide $Fe_3O_4$. The preferred form is ferric oxide $Fe_2O_3$. The particle-size range of the iron oxide is such that 90% is below 10 microns. The carbon particles may be any of the varieties that can be used for making conductive coatings, although graphite is preferred. The particle-size range of the carbon particles is such that 90% of the particles is below 10 microns.

The silicate binders are in aqueous solutions of about 10 to 65 weight percent solids. The weight ratio of $SiO_2/Li_2O$ in the lithium silicate solution is in the range of about 4.0 to 20.0. Suitable lithium silicates are described in U.S. Pat. No. 2,668,149 to R. K. Iler, U.S. Pat. No. 3,459,500 to M. A. Segura et al and U.S. Pat. No. 3,565,675 to R. H. Sams. The weight ratios $SiO_2/K_2O$ and $SiO_2/Na_2O$ in each of the potassium silicate and sodium silicate solutions are in the range of 1.6 to 3.8. The mixture of silicate binders preferably includes all three of sodium and potassium and lithium silicates, but may be of potassium and lithium silicates, or of sodium and lithium silicates. The weight ratio, on a dry basis, of lithium silicate to potassium silicate and sodium silicate may be in the range of 1.2–2.1 to 2.5–3.5. Put another way, the silicate solids (100%) may be 25 to 45 weight percent lithium silicate, 55 to 75 weight percent potassium silicate and/or sodium silicate.

Lower weight ratios of silica to alkali ($Li_2O$ plus $Na_2O$ plus $K_2O$) in the suspensions generally yield coatings that are more adherent to glass but absorb greater amounts of moisture. Higher weight ratios of silica to alkali in the suspensions generally yield coatings that absorb lesser amounts of moisture but are less adherent to glass. Higher weight ratios of $Li_2O$ to $Na_2O$ plus $K_2O$ in the suspensions generally yield coatings that are harder and less absorbent of moisture. Too high a $Li_2O$ content yields coatings that may flake off the glass surface. Lower weight ratios of $Li_2O$ to $Na_2O$ plus $K_2O$ in the suspensions yield coatings that are softer and more adsorbent of moisture. Too low a $Li_2O$ content yields coatings that are too absorbent of moisture and produce too high a particle count on the scratch test.

The constituents of the suspension are mixed together preferably with about 0.1 to 0.3 weight percent of dispersant. The constituents of the coating formulation are mixed together and then ball milled for a period of time, for example about 6 hours. Changing the weight proportions of iron oxide, graphite and silicate binder affects the electrical resistance of the final coating. Increasing the proportions of iron oxide increases the electrical resistance of the finished coating. Increasing the proportions of silicate binder increases the electrical resistance and scratch resistance of the finished coating. Increasing the proportions of graphite decreases the electrical resistance and decreases the scratch resistance of the finished coating. However, the internal coatings described herein provide a set of practical compromises of the electrical and physical properties needed for their fabrication and use in cathode-ray tubes.

The coating suspension may be applied by any convenient process. It is preferred to brush the coating onto the interior wall of the neck 23 so that a sharply defined edge is produced opposite the mount assembly 35. It is preferred to spray the coating formulation onto the interior surface of the funnel 25, overlapping the brushed-on portion. Spraying is a rapid process for covering the relatively large funnel area. Either air or airless spraying can be used.

The physical and electrical properties of the internal coating employed in the novel tube and similar prior coatings used in prior tubes have been measured. The accompanying TABLE 1 gives average values and ranges for data for three to six samples taken in comparative tests on four coatings A, B, C and D, along with the formulations in weight percent on a dry solids basis. The tests for hardness, adherence, scratch resistance and electrical resistance are essentially the tests that are described in U.S. Pat. No. 3,791,546 to J. J. Maley et al. Viscosity values were obtained with a No. 2 Zahn cup. The pH values of the coatings were measured with "Short Range Alkacid Paper" from Fisher Scientific Co.

TABLE 2 gives the percent weight increase of the designated coatings as a function of time and ambient relative humidity. To prepare the coatings for measurement, a draw-down blade was used to coat weighed glass plates with each of the coatings being evaluated. The surface dimensions of the plates were 2.75 inches × 4.00 inches. The coated plates were baked at 450° c for 1 hour. After cooling, the plates were placed in a desiccator for two days. The plates were again weighed, yielding the dry coating weight. Next, the plates were placed in a chamber having a constant humidity atmosphere. One hundred percent humidity was obtained with an open container of pure water in the chamber. An open container of a saturated solution of $NH_4Cl$ in the chamber produced 79.3% relative humidity, and an open container of a saturated solution of $Na_2Cr_2O_7$ in the chamber produced a 52% relative humidity. After exposing coated plates to these humidities for 2 hours, 6 hours and 24 hours, the plates were removed from th chamber and weighed. The difference between this weight and the dry coating weight of the plate was the amount of water adsorbed by the coating.

Moisture adsorption is an important property of an internal conductive coating since the amount of adsorbed moisture affects the tube life. Past experience in life factorial testing has shown that the emission life of cathodes in tubes that were flushed with dry air just after frit sealing is always as good as or better than cathodes in unflushed tubes. If tubes are to be held for any extended length of time after frit sealing, dry air flushing always improves the life of the tube. Also, it has been shown that the use of an internal coating containing iron oxide significantly increases the emission life of kinescopes. All of these observations relates to the moisture adsorption properties of conductive coatings.

The moisture adsorption data of TABLE 2 shows that the A and B coatings, which contain no lithium silicate, absorb much more moisture than the C and D coatings which contain lithium silicate. The B and D coatings, in which iron oxide is substituted for some of the graphite, exhibit lower moisture adsorption than the A and C coatings which do not contain iron oxide. The D coating, containing iron oxide and a mixture of three silicates, adsorbs the least moisture.

Tests on coated plates have shown that baking temperatures as low as 50° C are adequate for developing the desirable characteristics of the coatings described herein. After thoroughly drying the coatings described herein, they can be washed with water, either before or after being baked, without loss of adherence. Water washing can be used to advantage to remove any loose surface particles or dirt and also to reduce the alkali content of the coatings by leaching. This is to be contrasted with similar coatings which do not contain lithium silicate. Similar coatings containing only sodium and/or potassium silicate as the binder require baking temperatures of at least 400° C to develop sufficient insolubility to permit them to be washed with water without losing adherence.

TABLE 1

| Coating Code | A | B | C | D |
|---|---|---|---|---|
| Graphite | 64.00 | 20.65 | 65.48 | 21.40 |
| Iron Oxide | 0 | 45.45 | 0 | 39.75 |
| Sodium Silicate | 34.55 | 33.44 | 10.62 | 16.52 |
| Lithium Silicate | 0 | 0 | 14.40 | 13.45 |
| Potassium Silicate | 0 | 0 | 6.88 | 6.43 |
| Dispersant | 1.45 | 0.45 | 2.62 | 2.45 |
| Viscosity | 21.0 | 18.4 | 18.4 | 18.3 |
| (Seconds) | 19.9–21.6 | 18.0–19.1 | 17.5–19.0 | 17.5–18.8 |
| pH of Coating | 13.2 | 13.1 | 13.1 | 13.3 |
| | 13.2–13.3 | 13.0–13.2 | 13.0–13.2 | 13.3–13.4 |
| Density (Liquid) | 1.19 | 1.30 | 1.23 | 1.31 |
| ($g/cm^3$) | 1.16–1.25 | 1.27–1.35 | 1.23–1.24 | 1.27–1.35 |
| Density (Baked) | 1.12 | 1.44 | 1.10 | 1.94 |
| ($g/cm^3$) | 0.85–1.29 | 1.13–1.82 | 0.98–1.17 | 1.42–2.24 |
| Thickness | 0.75 | 0.73 | 0.63 | 0.60 |
| (Mils) | 0.7–1.2 | 0.6–0.9 | 0.4–0.8 | 0.4–0.7 |
| Electrical | 68 | 232 | 77 | 255 |
| Resistance | 55–80 | 180–260 | 65–90 | 190–300 |
| (Ohms/Inch) | | | | |
| Hardness | 110 | 750 | 160 | 470 |
| (Hoffman-g) | 100–125 | 700–800 | 150–175 | 400–550 |
| Scratch | 2398 | 1331 | 2860 | 1656 |
| Resistance | 1870–2780 | 960–1830 | 1670–4275 | 1200– |
| (Particles) | | | | 2260 |

TABLE 2

| Percent Weight Increase of Coatings | | | | | | | | | |
|---|---|---|---|---|---|---|---|---|---|
| | 100% Humidity | | | 79.3% Humidity | | | 52% Humidity | | |
| Coating Code | 2 Hours | 6 Hours | 24 Hours | 2 Hours | 6 Hours | 24 Hours | 2 Hours | 6 Hours | 24 Hours |
| A | 26.9 | 30.4 | 107.6 | 12.1 | 22.9 | 27.9 | 4.0 | 5.9 | 14.4 |
| B | 7.5 | 14.6 | 75.1 | 4.2 | 9.0 | 16.1 | 1.4 | 2.0 | 9.6 |
| C | 2.8 | 3.4 | 45.8 | 2.2 | 3.2 | 6.1 | 1.6 | 1.8 | 2.6 |
| D | 1.4 | 2.5 | 25.9 | 1.3 | 1.5 | 4.0 | .6 | 1.0 | 2.2 |

We claim:

1. A cathode-ray tube comprising an evacuated envelope and a conductive coating adhered to at least a portion of the interior walls of said envelope, said coating comprising carbon particles and a silicate binder consisting essentially of about 25 to 45 weight percent lithium silicate and about 75 to 55 weight percent of at least one member of the group consisting of sodium silicate and potassium silicate, said coating having a point-to-point electrical resistance of about 200 to 2,000 ohms per inch.

2. The tube defined in claim 1 wherein the coating contains, per 100 weight parts carbon particles, about 50 to 400 weight parts of a mixture of lithium silicate and sodium silicate.

3. The tube defined in claim 1 wherein the coating contains, per 100 weight parts carbon particles, about 50 to 400 weight parts of a mixture of lithium silicate and potassium silicate.

4. The tube defined in claim 1 wherein said coating contains, per 100 weight parts carbon particles, about 50 to 400 weight parts of a mixture of lithium silicate, sodium silicate and potassium silicate.

5. The tube defined in claim 1 wherein said coating contains, per 100 weight parts carbon particles, up to 600 weight parts iron oxide particles.

6. The tube defined in claim 1 wherein said coating comprises graphite particles, iron oxide particles and a silicate binder consisting essentially of a mixture of lithium silicate and at least one of sodium silicate and potassium silicate, said lithium silicate comprising about 25 to 45 weight percent of said silicate binder.

7. The tube defined in claim 6 wherein said coating contains, per 100 weight parts graphite particles, 150 to 250 weight parts iron oxide and about 50 to 400 weight parts of a mixture of lithium silicate and sodium silicate.

8. The tube defined in claim 6 wherein said coating contains, per 100 weight parts graphite particles, 150 to 250 weight parts iron oxide and about 50 to 400 weight parts of a mixture of lithium silicate and potassium silicate.

9. The tube defined in claim 6 wherein said coating contains, per 100 weight parts graphite particles, about 150 to 250 weight parts iron oxide, and about 50 to 400 weight parts of a mixture of lithium silicate, sodium silicate and potassium silicate.

10. The tube defined in claim 9 wherein said coating contains, per 100 weight parts graphite particles, about 125 to 175 weight parts of said mixture of silicates.

* * * * *

UNITED STATES PATENT OFFICE

CERTIFICATE OF CORRECTION

PATENT NO. : 4,041,347

DATED : August 9, 1977

INVENTOR(S) : Samuel Broughton Deal & Donald Walter Bartch

It is certified that error appears in the above-identified patent and that said Letters Patent are hereby corrected as shown below:

| | |
|---|---|
| Column 1, line 17 | change "tub" to --tube-- |
| Column 1, line 50 | change "absorbs" to --adsorbs-- |
| Column 3, line 30 | change "cathoderay" to --cathode-ray-- |
| Column 5, line 44 | change "relates" to --relate-- |

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*